United States Patent [19]

Cartwright et al.

[11] 4,034,667

[45] July 12, 1977

[54] HOT STAMPING MACHINE WITH ROTATABLE HEAD

[76] Inventors: Vern W. Cartwright, Executive Airport, Sacramento, Calif. 95822; Carlos W. Veach, 9021 Ashcroft Ave., Los Angeles, Calif. 90048

[21] Appl. No.: 601,092

[22] Filed: Aug. 1, 1975

Related U.S. Application Data

[63] Continuation-in-part of Ser. No. 513,828, Oct. 10, 1974, abandoned.

[51] Int. Cl.[2] ..... B44B 5/02

[52] U.S. Cl. ..... 101/27; 101/31; 101/316; 101/398

[58] Field of Search ..... 101/3 SP, 9, 10, 21, 101/27, 31, 316, 368, 372, 373, 381, 398, 399

[56] References Cited

U.S. PATENT DOCUMENTS

| | | | |
|---|---|---|---|
| 1,520,235 | 12/1924 | Geer | 101/27 |
| 2,301,010 | 11/1942 | Boutiette | 101/31 X |
| 2,621,435 | 12/1952 | Weber | 101/27 |
| 2,833,209 | 5/1958 | Gustafson | 101/93 C X |
| 3,587,454 | 6/1971 | Meyer et al. | 101/3 SP |
| 3,613,570 | 10/1971 | Gladen | 101/31 X |
| 3,868,904 | 3/1975 | Wulf | 101/316 |

*Primary Examiner*—Edward M. Coven
*Attorney, Agent, or Firm*—Wilkinson, Mawhinney & Theibault

[57] ABSTRACT

The present disclosure is directed to a hot stamping machine with a rotatable head for imprinting information on each individual frame of a roll of negatives or transparencies used in aerial photography whereby the printing head may be rotated to imprint on either side of individual negatives. The hot stamping machine has a static member and a movable member which is pivotally connected thereto for horizontal rotation about a vertical pivot. This rotatable head makes it possible to imprint on either the top or bottom of individual frames of a negative or transparency being fed through a machine and have the imprint read correctly. In addition, individual type holder blocks can be arranged in any desired position, and can be rotated so that the information contained on each type holder block will be imprinted or not, as may be desired. Finally, a provision is made for easily adjusting the pressure on either side of the imprinting head so as to ensure optimum imprinting with a minimum embossing of the film.

3 Claims, 9 Drawing Figures

FIG. 1
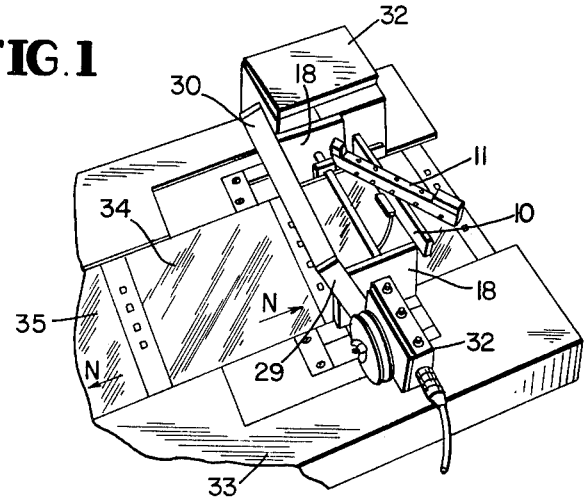
FIG. 2
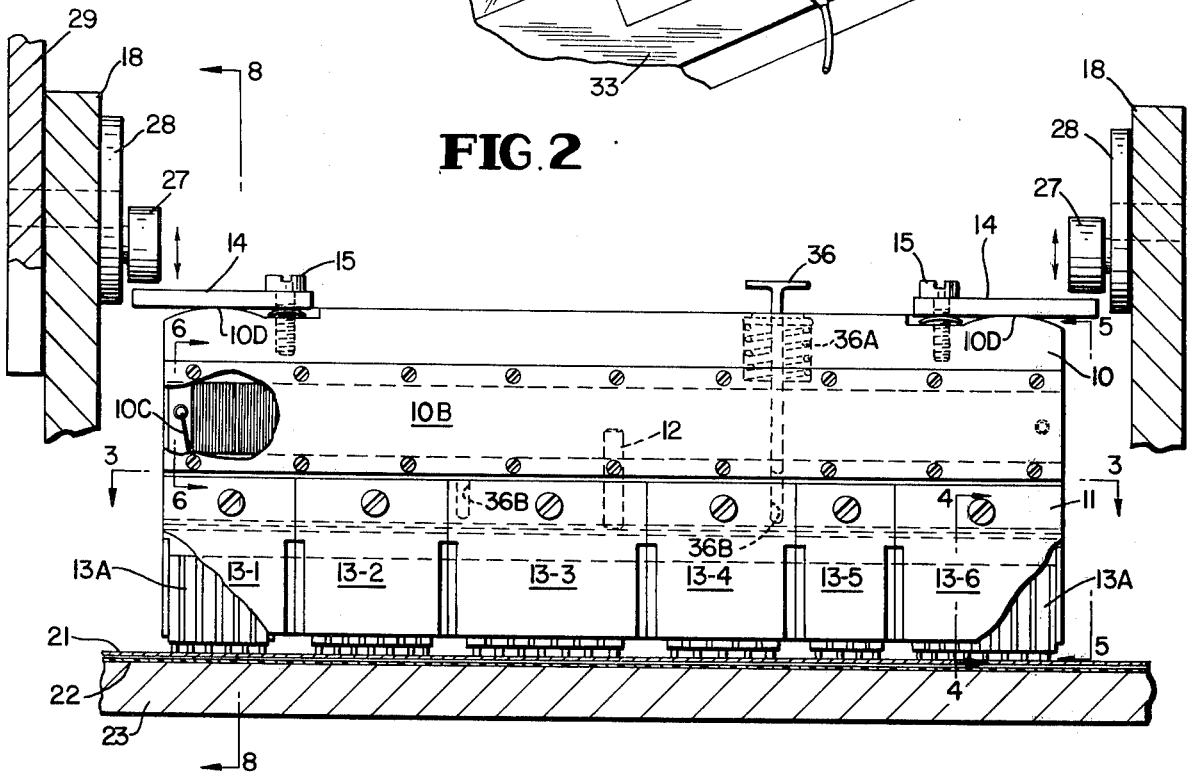
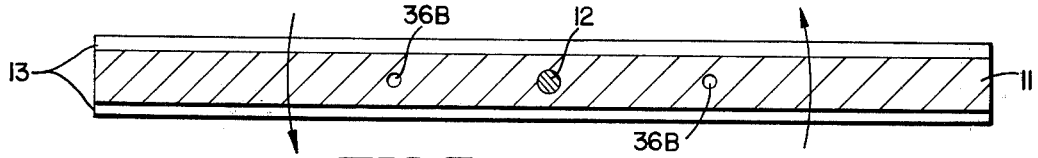
FIG. 3
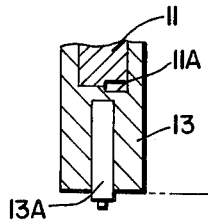
FIG. 4
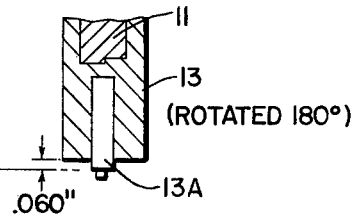
FIG. 4A
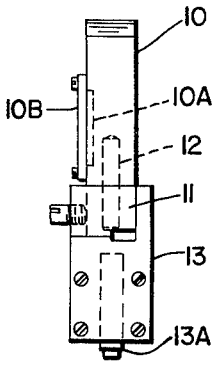
FIG. 5
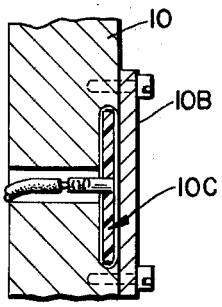
FIG. 6

HOT STAMPING MACHINE WITH ROTATABLE HEAD

This application is a continuation-in-part of application Ser. No. 513,828, filed Oct. 10, 1974, now abandoned.

THE PRIOR ART

A hot stamping machine is a machine employing heated metal type which is pressed down upon a specially prepared "foil"; the resultant pressure and temperature exerted upon the "foil" for a short time such as fraction of a second causes the exact image of the type to be transferred to the material placed under the foil prior to applying the heated type. Such "foil" usually consists of a thin film of acetate or polyester (e.g. Mylar); on one side of which there is a special preparation known as a "release agent", and a "transfer material" over the "release agent". The transfer material may be pigments or metallic powders; in either case the end result is the transfer of said "transfer material" onto the material over which the foil had previously been placed and the heated type pressed down upon.

An object of the present invention is to provide a hot stamping machine for imprinting information on negatives or transparencies used in aerial photography so that it is possible to imprint on either the top or bottom of each frame of a roll of negatives or transparencies fed through a machine and have the imprint read correctly (read "up").

A further object of the present invention is the provision of a hot stamping machine having a horizontally movable member which is pivoted about a vertical pivot; said horizontally movable member utilizes a number of individual type holder blocks which may be placed in any position and sequence along the movable member and in addition can be individually turned about 180° so that type contained in the individual block will either imprint or not, all type holder blocks will remain at temperature required for imprinting.

A still further object of the present invention is the provision on the movable or horizontally rotatable member to hold consecutive numbering machines such as are employed in serial numbers on bank checks.

Another object of the present invention in addition to the foregoing is a means for rapidly and easily adjusting the pressure on either end of the entire imprinting head because of the requirement of absolutely minimum embossing of the negatives or transparencies.

With the foregoing and other objects in view the invention will be more fully described hereinafter and more particularly pointed out in the appended claims.

In the drawings in which like parts are denoted by reference characters throughout the several views:

FIG. 1 is a fragmentary perspective view of an aerial photograph imprinting device incorporating the hot stamping machine with rotatable head thereon for numbering individual frames of rolls of aerial film negatives or transparencies. For clarity the hot stamping machine is NOT shown in the imprinting position; rather it is in the position wherein the rotatable head can be rotated, and is shown partially rotated.

FIG. 2 is a front elevational view of the hot stamping machine of the present invention thereon.

FIG. 3 is a horizontal sectional view of the present invention taken on the line 3—3 in FIG. 2.

FIG. 4 is a transverse section taken on the line 4—4 in FIG. 2.

FIG. 4A is a view similar to FIG. 4 with the movable member rotated 180°.

FIG. 5 is an end elevational view of a part of the structue of FIg. 2 taken along the line 5—5.

FIG. 6 is a vertical sectional view taken on the line 6—6 in FIG. 2.

Figure 7:
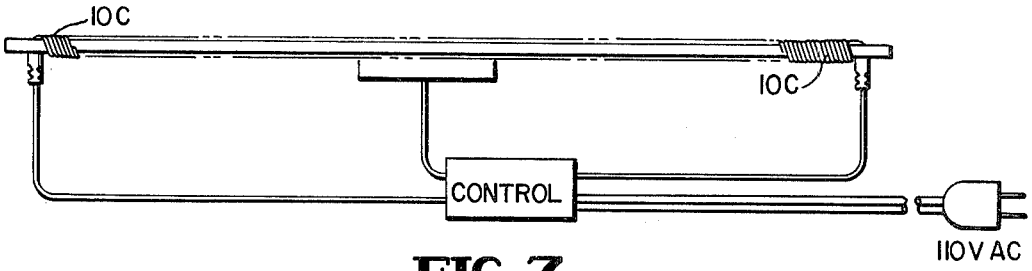
FIG. 7 is a schematic of the heating unit in the static member.

Referring now to the drawings, and for the moment to FIG. 2, 10 designates the static member and 11 the movable or rotary member. The movable member 11 is horizontally rotatable beneath and connected to the static member 10 by a vertically disposed pivot pin 12. Individual type holder blocks 13 are detachably connected to the movable member 11 and these type holder blocks may be replaced with a similar block containing a consecutive numbering machine such as are employed in serially numbering bank checks.

The static member 10 has a cavity or recess 10A for housing heater units 10C of nicrome wire for heating the hot stamping machine. A cover plate 10B is retained in place by screws, as best seen in FIGS. 2 and 5. Atop the static member 10 are a pair of lugs 14 having adjusting screws 15 which permits of rapid easy and precise adjustments of pressures on the right and left side of the imprinting head by turning the screws in or out causing the lugs 14 to rock about the rounded shoulders 10D on the static member 10.

As shown in FIGS. 4 4A and 5 it will be noted that slightly more than half of the pressure transmitting surface of both the movable member 11 and type holder block 13 is cut away at 11A of the order of 0.03 in practice so that the individual type holder will be raised by 0.06 and not imprint if individually turned around 180° on member 11. The movable member 11 which carries the type holder blocks can itself be rotated 180° about the center pin 12 and locked in either position to assure proper printing, right side up, for north and south passes of the aircraft.

Figure 8:
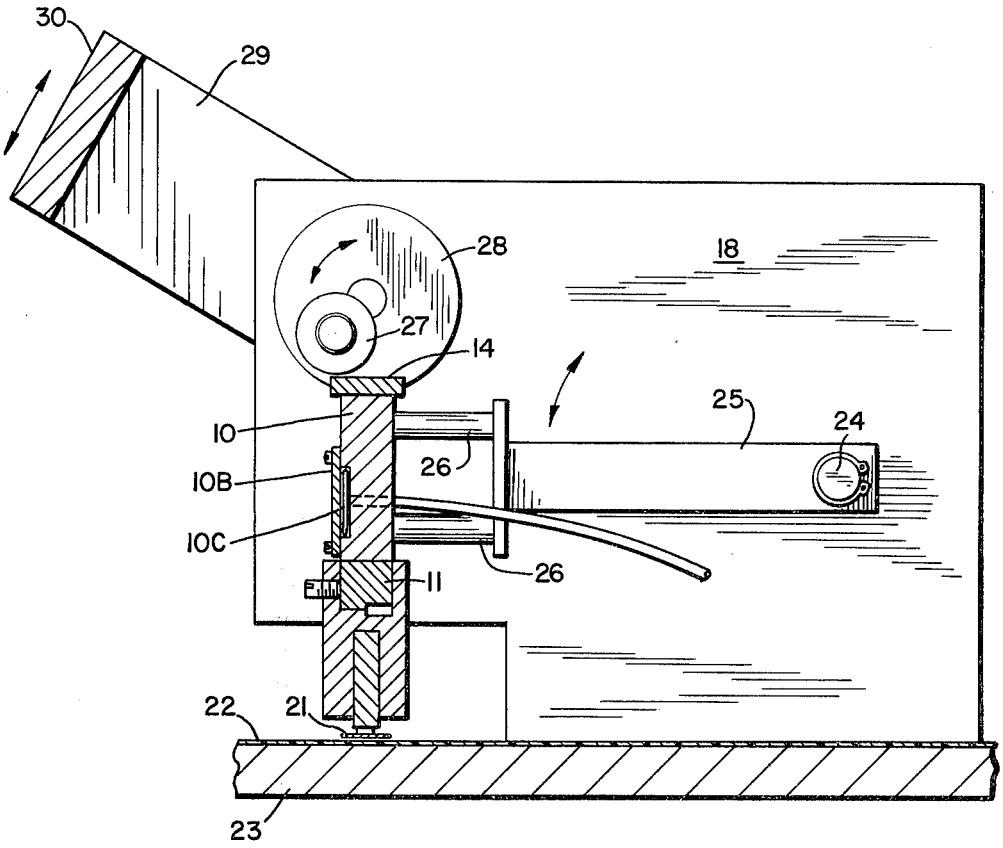
FIG. 8 is a vertical section taken on the line 8—8 in FIG. 2.

The machine 32 upon which the imprinting device is mounted applies force (pressure) to the hot stamping machine through cams 27 on the right and left as best seen in FIG. 8. A pair of end plates 18 upstand from a base 23 over which passes the film nagative 22 over which passes the foil 21 against which the type 13A in the type holder block bears.

Journaled between each end plate 18 is a shaft 24 having arms 25 to which the static member 10 is secured by a heat insulating stand off 26 so that the arms 25 and static member 10 and its pivotally connected horizontally movable member 11 can be raised and lowered in the direction of the arrow in FIG. 8. The printing pressure is transmitted to the static head 10 by a cam 27 eccentrically mounted on a disc 28 recessed in the end plates 18 and actuated by arms 29 and 30. The arm structure 29 and 30 may be raised and lowered manually or automatically to apply printing pressure. Each cam 27 acts upon the lugs 14 to apply printing pressure as shown in FIG. 2. A vernier or fine pressure adjustment can be attained by taking down on or backing off screws 15 to rock the lugs 14 about the rounded shoulders 10D shown in FIG. 2.

A spring loaded detent pin 36 is carried in an opening 36A in the static member 10 and enters an opening 36B in the movable member 11 to lock the movable member 11 in each of its positions of rotation.

OPERATION

The complete application of the invention is best shown in FIG. 1. The complete hot stamping machine with rotatable head is incorporated into an aerial photographic imprinting machine, the foil feed and the foil take up of the aerial photographic imprinting machine are shown as items 32 in FIG. 1. The aerial photographic imprinting machine in turn is mounted on a suitable platform 33. Items 34 and 35 represent two frames of a roll of aerial film to be imprinted; the aircraft used in taking the photographs was headed North in frame 34, but headed South in frame 35. Since it is required that identification of each frame always be placed on the "North" side of a frame and reading "up", it is necessary to rotate the imprinting head after imprinting frame 34. This is accomplished using the apparatus of FIG. 2 and by rotating the movable member 11 so that each frame may be imprinted on the "North" side, regardless of the orientation of the individual frame.

Referring now to FIG. 2, pressure is applied to both the RIGHT and LEFT sides of the entire imprinting head, items 10 and 11, through the two cams 27, each marked "27". In this application the two cams 27 are actually ball bearings in order to reduce friction. The cam arrangement operates simultaneously against both lugs 14; since the two cams 27 are rigidly locked together by items 28, 29 and 30, it follows that equal pressures will be exerted on the heated type 13A and consequently on the foil 21 on both the RIGHT and LEFT sides simultaneously provided that all of the vertical dimensions are identical on the RIGHT and LEFT sides. Now in practice, it is absolutely impossible to machine all items so that this is true; in practice it is difficult to hold the accumulated tolerances to ±0.002 (about half the thickness of a human hair). This error of ±0.002 is sufficient to cause one side to imprint normally, and the other side to either emboss very heavily or not at all — depending upon the direction of the tolerances. Now in this application it is the UTMOST importance that the pressures be as nearly identical as possible, to cause even imprinting with little or no embossing; the lugs 14 and screws 15 provide a simple and effective means of independently increasing or decreasing the pressures on the RIGHT or LEFT side of the assembly shown in FIG. 2 by adjusting the individual screws 15.

Referring to FIGS. 2 and 8, it will be observed that if the two lugs 14 are rotated about the screws 15, the entire imprinting head assembly, items 10 and 11, can be rotated about item 24 until the entire imprinting head is in the position shown in FIG. 1; in this position the operator can easily change or interchange any combinations of type or items 13-1 through 13-6.

Again referring to FIG. 2 and also to FIG. 5, it can be seen that the upper part (above the secton 3—3) can be rotated 180° about the pin 12; when this is done the imprint formerly on the RIGHT will now be on the LEFT, and vice-versa. This is an extremely important feature when imprinting upon long (100 feet and over) aerial films; this requirement is set forth in various governmental regulations governing the placement of annotations and titles on aerial films, according to the direction the airplane was flying at the time the picture was taken. For example, if planes are flying a north-south pattern, the requirement is generally that the title must be imprinted on the NORTH side of the film. In the flying pattern, the plane first flies NORTH for a prescribed distance, then SOUTH, then NORTH, etc.; thus the ROTATABLE HEAD is necessary so that the imprint made with the machine can always be on the NORTH side of the film, and reading correctly, and which, as pointed above, is absolutely necessary for imprinting on any aerial films covered by most governmental regulations.

For further clarity, the individual type holder blocks are numbered 13-1 through 13-6. Now if the blocks 13-1, 13-2, 13-3 13-4 and 13-6 are held in the same position, but block 13-5 is raised by a small amount (such as 0.060) and if the the machine is operated so that the type in all but 13-5 imprint properly, then the type contained in 13-5 WILL NOT PRINT, as it will be approximately 0.060 too high and will not touch the foil. The manner in which the individual type holder blocks can be raised is shown in FIGS. 4 and 4A; in FIG. 4A the block has been rotated 180° and consequently is 0.060 higher and hence cannot imprint as it does not touch the foil. One might ask, why not just remove the type holder block, in which case it would not imprint. The answer is this: in operation it is desired to have the type heated at all times — if the block 13-5 is removed, it will cool down and when replaced the operator will be required to wait until it has again heated up to temperature. Hence this feature is a means of preventing the imprinting of a particular type holder block and yet keeping the type heated.

Regarding "UNDERCUT TYPE". It is NOT the type that is undercut, but a portion of the type holder block and item 10 that is partially horizontally cut away to accomplish the feature described in the paragraph above.

Numbering machines are made the same height as is standard type. In this application of a numbering machine, a commercial machine is fastened into a type holder block, such as 13-6; the numbering machine is thus heated in the same way as is type in the other type holder blocks, and causes an imprint in exactly the same way as does the type in the other type holders 13-1 through 13-5. In the commercial numbering machine there is a provision whereby the number advances one digit as each imprint is made.

What we claim is:

1. For use in numbering negatives or transparencies used in aerial photography, a rotatable imprinting head for hot stamping machines having a printing force applied to the imprinting head comprising in combination a bar-like static member, a movable bar-like member, a vertical pivotal connection between said static and movable members whereby said movable member can be selectively rotated horizontally about said vertical pivotal connection to the static member for 180° rotation relative thereto, heating means in said static member, type holder blocks detachably carried along the bottom of said movable member, and pressure adjusting means comprising a pair of arms, one arm extending off each end of the static member and connected thereto by a threaded adjustment screw at the inward portion of each arm, and said static member has a curved fulcrum proximate each end portion of the static member beneath a central portion of each arm whereby the arms are rocked over the curved fulcrum to increase or decrease printing pressure when the printing force is applied to the outer portions of the arms.

2. For use in numbering negatives or transparencies used in aerial photography, a rotatable imprinting head for hot stamping machines having a printing force applied to the imprinting head comprising in combination a bar-like static member, a movable bar-like member, a vertical pivotal connection between said static and movable members whereby said movable member can be selectively rotated horizontally about said vertical pivotal connection to the static member for 180° rotation relative thereto, heating means in said static member, type holder blocks detachably carried along the bottom of said movable member, more than one half of the movable member and one half of each of the individual type holder blocks being cut away horizontally so that the cutaway portion of a selected block in a first position will not engage the movable member and enable the block to print and in a second position when the block is rotated 180° the cutaway portion of the block will engage the movable memnber so that the block will not print, yet all of the type holder blocks will remain at the temperature needed for imprinting.

3. A rotatable imprinting head as claimed in claim 2 further comprising pressure adjusting means including a pair of arms, one arm extending off each end of the static member and connected thereto by a threaded adjustment screw at the inward portion of each arm said static member having a curved fulcrum proximate each end of the static member beneath a central portion of each arm whereby the arms are rocked over the curved fulcrum to increase or decrease printing pressure when the printing force is applied to the outer portions of the arms.

* * * * *